US005155314A

United States Patent [19]

Dufournet et al.

[11] Patent Number: 5,155,314

[45] Date of Patent: Oct. 13, 1992

[54] MEDIUM OR HIGH TENSION CIRCUIT BREAKER HAVING END-TO-END ARCING CONTACTS

[75] Inventors: Denis Dufournet, Bron; Michel Perret, Bourgoin-Jallieu, both of France

[73] Assignee: GEC Alsthom SA, Paris, France

[21] Appl. No.: 679,403

[22] Filed: Apr. 2, 1991

[30] Foreign Application Priority Data

Apr. 4, 1990 [FR] France ..... 90 04316

[51] Int. Cl.[5] ..... H01H 33/88

[52] U.S. Cl. ..... 200/148 A; 200/148 B

[58] Field of Search ..... 200/148 R, 148 A, 148 B, 200/148 BU, 150 G

[56] References Cited

U.S. PATENT DOCUMENTS

| | | | |
|---|---|---|---|
| 4,309,581 | 1/1982 | Macaire et al. | 200/148 R |
| 4,327,263 | 4/1982 | Sakurai et al. | 200/148 A |
| 4,556,767 | 12/1985 | Egli et al. | 200/148 A |
| 4,774,388 | 9/1988 | Thuries et al. | 200/148 A |

FOREIGN PATENT DOCUMENTS

| | | |
|---|---|---|
| 0011542 | 5/1980 | European Pat. Off. . |
| 212352 | 12/1982 | Fed. Rep. of Germany . |

*Primary Examiner*—J. R. Scott

*Attorney, Agent, or Firm*—Sughrue, Mion, Zinn, Macpeak & Seas

[57] ABSTRACT

A gas filled medium tension circuit breaker includes an insulating case with a fixed first arcing contact connected to a first circuit breaker terminal. The circuit breaker includes moving equipment formed of a slidable first tube axially displaceable by a drive rod connected to one end of the slidable first tube. The slidable first tube is connected by contacts to a second circuit breaker terminal. The first tube and a fixed second tube define a blast volume. The second tube is extended by a blast nozzle. A second arcing contact is defined by a third tube which slides inside a small diameter portion of the slidable first tube, with that small diameter portion defining with the second tube the blast volume. A larger diameter second portion of the slidable first tube carries the blast nozzle. The two portions of the slidable first tube interconnect radially by a substantially annular portion having through holes and a shoulder. The annular portion constitutes a blast piston which moves axially within the blast volume. The third tube includes a radial flange proximate to the fixed first arcing contact. A compression coil spring has one end bearing against the flange. A second end bears against the shoulder. The drive rod coil spring is compressed when the second movable tube is shifted towards the fixed first arcing contact to cause the arcing contacts to engage end-to-end in a closed position.

1 Claim, 3 Drawing Sheets

PRIOR ART

MEDIUM OR HIGH TENSION CIRCUIT BREAKER HAVING END-TO-END ARCING CONTACTS

The invention relates to a circuit breaker having end-to-end contacts and suitable for use in high tension or medium tension electrical circuits.

In circuit breakers having end-to-end contacts and of the type including a blast piston, it is desirable for the blast of gas to be compressed during a disengagement operation before the arcing contacts separate so that the subsequent arc blasting is more energetic and thus more effective.

BACKGROUND OF THE INVENTION

A circuit breaker of this type is shown diagrammatically in accompanying FIG. 1 which is a fragmentary view in axial half-section. Reference 1 designates a drive rod 1 connected to a tube 2 carrying a blast piston 3 provided with passages 3A and a blast nozzle 4. A blast volume 5 is defined by the tube 2 and a fixed tube 6 which is coaxial therewith and which is integral with a block 7 that is connected to a first terminal of the circuit breaker (not shown). Contacts 7A provide the electrical connection between the block 7 and the sliding tube 2.

Reference 8 designates the fixed arcing contact, which is tubular in shape and which is connected to a second terminal of the circuit breaker (not shown).

The second arcing contact, referenced 9, is also tubular and constitutes a semi-moving contact subjected to thrust by a first end of a spring 10 whose second end bears against a shoulder of the tube 2. When the circuit breaker is in the engaged position, as shown in FIG. 1, portions of the tubes 9 and 2 overlap. On circuit breaker disengagement, the tube 2 begins to move without entraining the contact 9, thereby precompressing the volume 5 before the end-to-end contacts 8, 9 separate which happens only when the annular ends 2A and 9A of the tubes 2 and 9, respectively come into contact. Contacts 9B allow current to pass between the tube 9 and the tube 2.

It can be seen that this circuit breaker includes a large number of electrical contacts. An object of the present invention is to provide a circuit breaker having end-to-end arcing contacts but with a small number of electrical contacts so as to reduce the price of the circuit breaker and its maintenance costs.

SUMMARY OF THE INVENTION

According to the present invention, this object is achieved by a medium tension circuit breaker having end-to-end arcing contacts, the circuit breaker comprising, inside an insulating case filled with a gas having good dielectric properties: a first arcing contact which is fixed and connected to a first circuit breaker terminal; and moving equipment comprising a first tube displaceable by a drive rod, said first tube being connected by sliding contacts to a second circuit breaker terminal, said first tube co-operating with a fixed second tube to define a blast volume and being extended by a blast nozzle, said circuit breaker further including a second arcing contact, wherein the first tube is milled in such a manner to comprise a small diameter first portion co-operating with said second tube to constitute said blast volume, and a larger diameter second portion carrying said blast nozzle, the two portions being interconnected by a substantially annular portion including through holes and a shoulder and constituting a blast piston, said second contact being constituted by a third tube sliding inside said first portion of said first tube, said third tube having a flange having a first end of the spring bearing thereagainst, with the second end of the spring bearing against said shoulder, said spring being compressed when the circuit breaker is in the engaged position.

BRIEF DESCRIPTION OF THE DRAWINGS

An embodiment of the invention is described by way of example with reference to the accompanying drawings, in which.

DETAILED DESCRIPTION

Figure 1:
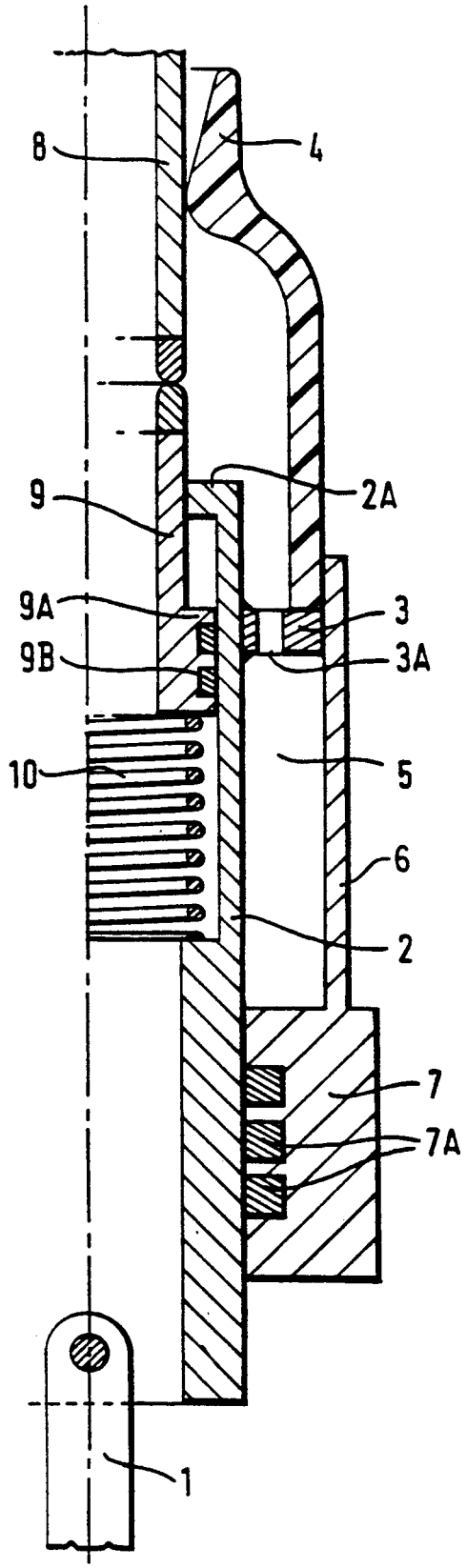
FIG. 1 is a fragmentary axial half-section of a prior art circuit breaker.

FIG. 1 which relates to the prior art is described above.

Figure 2:
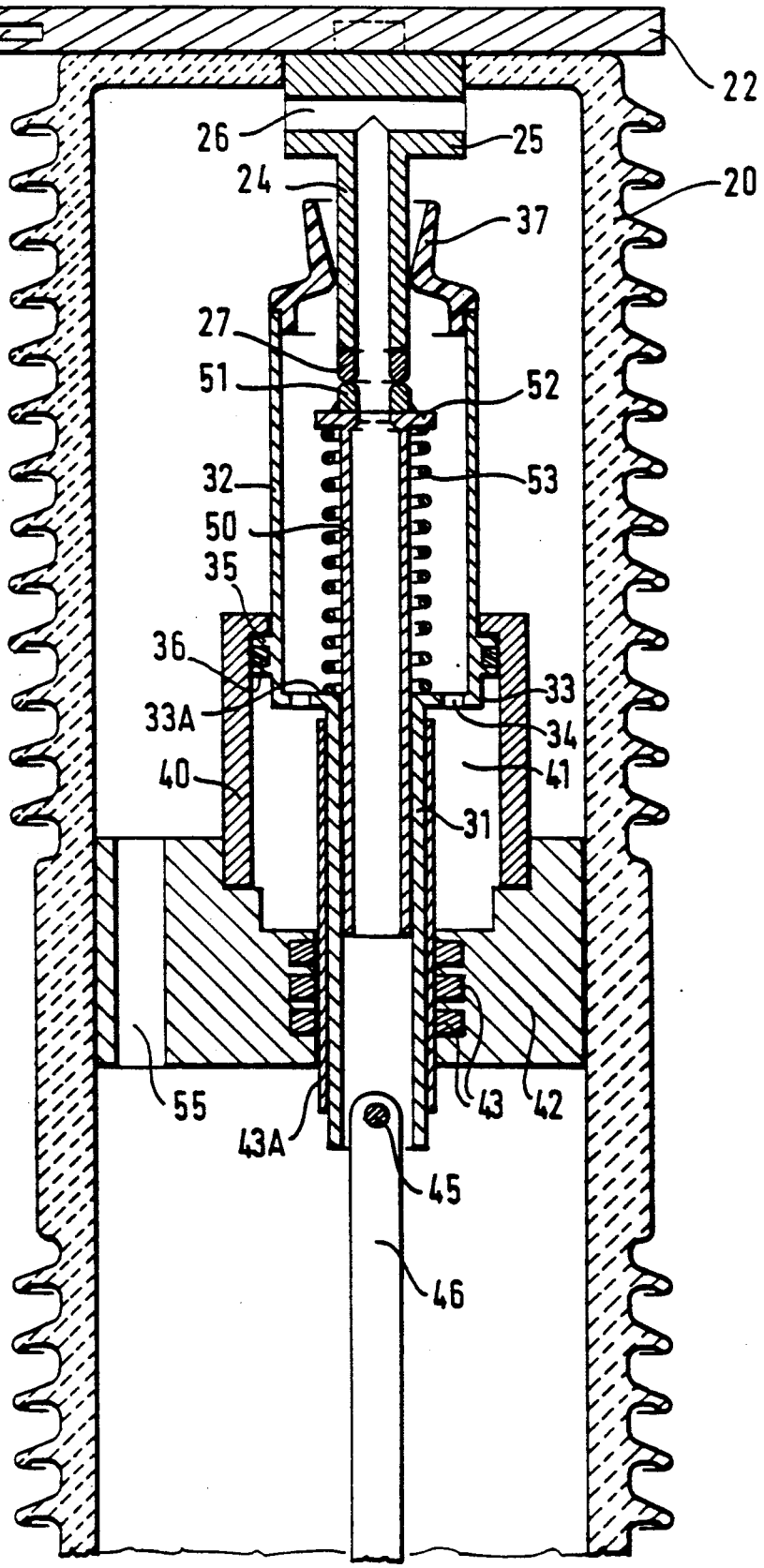
FIG. 2 is a fragmentary axial half-section of a circuit breaker of the invention, shown in the engaged position.

In FIG. 2, reference 20 designates a porcelain case delimiting a gastight enclosure containing a gas having good dielectric properties such as sulfur hexafluoride ($SF_6$), either pure or mixed with nitrogen, and under a pressure of a few bars.

The case 20 is closed at one end by a metal cover 22 carrying a first circuit breaker terminal 23.

The circuit breaker includes a fixed arcing contact 24 made in the form of a tube which is integral with a fixed block 25 connected to the cover 22 and pierced by a transverse passage 26 to facilitate gas circulation within the enclosure 21. The end 27 of the tube 24 is made of a material that withstands the effects of an electric arc, e.g. a tungsten-based alloy.

The moving equipment of the circuit breaker comprises a metal tube milled to include a small diameter portion 31 connected by a hinge 45 to a drive rod 46, and a larger diameter portion 32 carrying a blast nozzle 37 made of insulating material.

The portions 31 and 32 interconnected by a radial substantially annular portion 33 comprising a shoulder 33A, holes 34. A flange 35 is provided within a portion 32 having a sealing ring 36. This annular portion 33 constitutes a blast piston.

Together with a fixed tube 40 concentric about tube portion 32 and connected to a metal block 42, the tubular portion 31 defines a blast volume 41 in which tube 40 the above-mentioned piston 33 slides. The block 42 is connected to a second terminal (not shown) of the circuit breaker. Contacts 43 allow current to pass between the sliding tube portion 31 and the fixed block 42. Optionally, a layer 43A made of a suitable alloy, e.g. a silver-based alloy, provides improved electrical contact between the tube 31 and the contacts 43.

A tube 50 constituting the second arcing contact slides inside the smaller diameter tubular portion 31 and extends therefrom. The tube 50 has an end 51 made of an alloy that withstands the effects of an arc, and a flange 52 serving as a bearing surface for a first end of a compression coil spring 53 whose other end bears against the shoulder 33A of piston 33.

The circuit breaker operates as follows:

In the engaged position, the circuit breaker is in the configuration as shown in FIG. 2. The coil spring 53 is compressed, and current flows via the terminal 23, the cover 22, the block 25, the tube 24–27, the tube 51–50, the tube portion 31, the layer 43A, the contacts 43, the block 42, and the second terminal (not shown).

On disengagement, the drive rod 46 moves downwards in the figure entraining the tube portion 31. Under thrust from the spring 53 which expands progressively, the sliding tube 50 remains stationary so the contacts 27 and 51 remain in contact. During this stage, the gas in the volume 41 is compressed by the relative displacement of the piston 33 and of the fixed tube 40.

Figure 3:
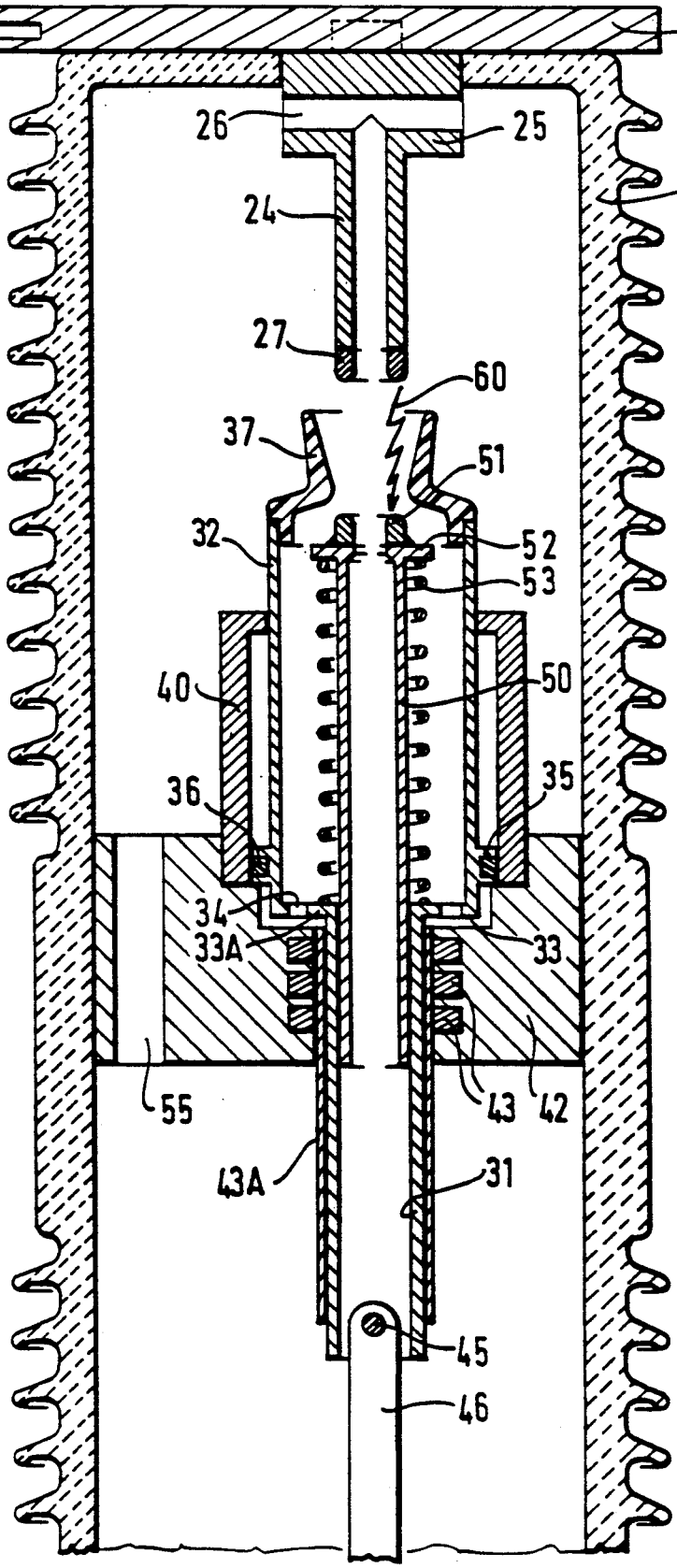
FIG. 3 is a fragmentary axial half-section of a circuit breaker of the invention shown in the disengaged position.

When the spring 53 has expanded fully, the tube 50 is entrained with the moving equipment. An arc 60 is struck between the contacts 27 and 51 (FIG. 3). Current then flows as follows: the terminal 23, the cover 22, the block 25, the tube 24–27, the arc 60, the tube 51–50, the tube 31, the layer 43A, the contacts 43, the block 42, and the second terminal (not shown). The arc is blasted by the compressed gas which escapes through the nozzle 37 and the arc is extinguished on the first current zero.

The passage 26 in the block 25 and a passage 55 in the block 42 allow the gas to flow freely inside the interrupting chamber, thereby facilitating the re-establishment of the dielectric qualities of the gas after a circuit breaking operation.

The circuit breaker of the invention has only two electrical contacts instead of a minimum of three in the prior art, and consequently its initial cost and its maintenance costs are reduced.

The invention is applicable to making medium or high tension circuit breakers up to about 45 kV.

We claim:

1. A medium tension circuit breaker having end-to-end arcing contacts, the circuit breaker comprising, inside an insulating case filled with a gas having good dielectric properties: a fixed first arcing contact connected to a first circuit breaker terminal; and moving equipment comprising a slidable first tube connected to a drive rod for axial displacement, said slidable first tube being slidably connected to contacts of a second circuit breaker terminal, said slidable first tube and a fixed second tube defining a blast volume, said fixed second tube being extended by a blast nozzle, said circuit breaker further including a movable second arcing contact, wherein the first tube comprises a small diameter portion acting with said second tube to constitute said blast volume, and a larger diameter portion carrying said blast nozzle, said two portions being interconnected radially by a substantially annular portion having through holes and a shoulder, said annular portion constituting a blast piston interiorly of said blast volume, said second arcing contact being constituted by a third tube sliding inside said small diameter portion of said slidable first tube, said third tube having a radial flange at an end thereof proximate to said fixed first arcing contact, a first end of a compression coil spring bearing against said flange, and a second end of the compression coil spring bearing against said shoulder, and said coil spring being compressed when the circuit breaker is in a condition where said piston is within said blast volume at an end closest to said fixed arcing contact by axial displacement of said drive rod thereby effecting spring biased engagement between said movable second arcing contact and said fixed first arcing contact.

* * * * *